United States Patent [19]

Goodwin et al.

[11] 4,083,473

[45] Apr. 11, 1978

[54] LIQUID BLENDING CONTROL SYSTEM

[75] Inventors: William Thomas Goodwin; Christopher William Ovens, both of Bracknell, England

[73] Assignee: Dresser Europe S. A., Brussels, Belgium

[21] Appl. No.: 732,290

[22] Filed: Oct. 14, 1976

[30] Foreign Application Priority Data

Oct. 14, 1975 United Kingdom ..... 42094/75

[51] Int. Cl.[2] ..... B67D 5/04; B67D 5/10

[52] U.S. Cl. ..... 222/144.5; 74/665 L; 74/674; 222/26

[58] Field of Search ..... 222/25, 26, 144.5, 145; 137/100; 74/661, 664, 665 R, 665 A–665 E, 665 L–665 N, 665 Q, 674, 675

[56] References Cited

U.S. PATENT DOCUMENTS

| | | | |
|---|---|---|---|
| 2,281,569 | 5/1942 | Fritsche | 74/665 Q X |
| 2,898,002 | 8/1959 | Blanchet et al. | 222/26 |
| 2,977,970 | 4/1961 | Young | 137/100 |
| 3,092,129 | 6/1963 | Steen | 222/26 X |
| 3,705,596 | 12/1972 | Young | 137/100 |

*Primary Examiner*—Allen N. Knowles
*Assistant Examiner*—Fred A. Silverberg
*Attorney, Agent, or Firm*—Wenderoth, Lind & Ponack

[57] ABSTRACT

A liquid blending system for providing three grades: (a) a first base grade; (b) a second base grade; and (c) a fixed blend proportion of the two. A blend control lever coupled to a valve is selectively driven by a differential receiving inputs from fluid meters in the base grade lines. Opposed solenoids pull the lever to one extreme or the other for the two base grades.

4 Claims, 4 Drawing Figures

LIQUID BLENDING CONTROL SYSTEM

The invention relates to a liquid blending control system and has particular, although not exclusive, application in liquid fuel dispensing pumps.

It is often necessary to blend two base liquids together in a predetermined proportion. It may be necessary to select two or three blends each comprising different proportions of the base liquids and in addition there is often the requirement to deliver only one base liquid or only the other base liquid, giving, in all, four or five possible grades of fuel which may be selected. For example, in fuel dispensing equipment it is the practice to have a fuel blending pump which delivers selected proportions of two base fuels, one being low octane and the other high octane. In this way intermediate octane ratings may be achieved. The blend control arrangements for such a system may be mechanical or electronic. The difficulty with a mechanical arrangement is that a considerable mechanical effort has to be applied by the pump operator in order to select grades, because this requires the changing of gear ratios. A purely electronic system has the disadvantage that it is expensive and complex.

Systems employed hitherto have required two or more intermediate blends between the purely low octane and the purely high octane grade selections. The present invention makes use of the discovery that by sacrificing all but one of the intermediate selections available, a particularly inexpensive and simple electromechanical blending control system may be provided.

According to the invention there is provided a liquid blending control system for providing an output which is selectively (a) a first liquid; (b) a second liquid; and (c) a predetermined blend of the first and second liquids, the system comprising first and second conduits for conveying the first and second liquids respectively; an outlet coupled to the conduits; a blend control valve connected to control the proportions of the first and second liquids admitted to the outlet from the conduits; an operating lever coupled to control the control valve; first and second solenoids coupled to the operating lever and effective, on being energised, to throw the control lever to one extreme position or the other extreme position respectively and thus control the blend control valve to produce at the outlet the first liquid only or the second liquid only respectively; first and second flow meters in the first and second conduits respectively; a differential having first and second inputs and an output shaft which turns in proportion to the difference between the drives applied to the two inputs; first and second gear trains coupling the flow meters to respective inputs of the differential; an electromagnetic clutch for selectively coupling the output shaft to turn the operating lever, the arrangement including the differential being such that when the clutch is engaged the blend control valve is controlled by the drive from the flow meters to maintain the predetermined blend; and a control circuit which allows one solenoid or the other or the clutch to be energised selectively in accordance with the output required.

It will be seen that with the arrangement described above there is only one intermediate blend available but this allows the provision of simple electromechanical control elements, such as solenoids and an electromagnetic clutch which removes the mechanical difficulty of selection prevalent with purely mechanical arrangements and which is more simple than purely electronic arrangements.

When the blend mode is selected the blend delivered will be determined by the ratio of the first and second gear trains. Preferably, the gears of at least the first or second gear train are readily changeable to allow the blend to be changed from time to time.

In a preferred embodiment of the invention there are electric pumps in the first and second conduits respectively and cut-out switches are provided for the respective pumps, each cut-out switch being operated by the operating lever when in a respective one of the extreme positions. In this way, if the lever is thrown to one of its extreme positions by operating one of the solenoids, then that pump which is delivering the liquid not required in that extreme position of the blend valve will be shut off.

This arrangement of cut-out switches in conjunction with the blend control arrangement described offers the advantage of automatic cut-out in the event of failure of one of the base grade supplies during dispensing of the intermediate blend. In the event of a blockage in one of the lines or an empty tank, for example, the blend control valve would be reset to deliver an increasing amount of the deficient base liquid until the lever reaches its extreme position and operates the respective microswitch. Delivery will then stop.

The invention will further be described with reference to the accompanying drawings in relation to a liquid fuel blending dispensing pump. In the drawings, FIG. 1 is a schematic block diagram of a liquid fuel dispensing pump embodying the invention;

Figure 1:
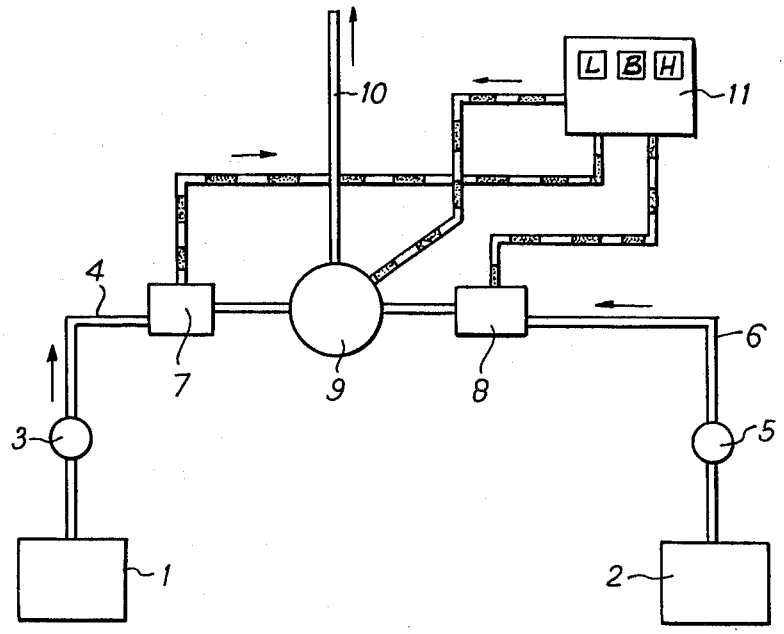

Referring to FIG. 1, the fuel pump draws liquid fuel (in this case petroleum) from a first supply tank 1 which contains low octane fuel and a second supply tank 2 which contains high octane fuel. The fuel is drawn from tank 1 by an electric pump 3 in a conduit 4. A similar electric pump 5 is provided in a conduit 6 for drawing fuel from the tank 2. The liquid flowing in conduits 4 and 6 is measured respectively by flow meters 7 and 8. The outputs from the flow meters are applied to a blend control valve 9 which supplies fuel of the required blend as an output in an outlet 10. A control unit 11 is provided which takes inputs from the flow meters 7 and 8 and provides a control output to the blend control valve 9.

The control unit 11 has three push buttons L, B & H which the customer depresses according to whether he requires low grade fuel, a predetermined blend, or high grade fuel. If low grade or high grade fuel is selected the blend control valve 9 is operated to one extreme or the other so that the output liquid is either purely low octane or purely high octane fuel as selected. Under these circumstances, as will be described, the other pump (5 or 3) is de-energised. When the blend button is depressed the blend control valve 9 is automatically controlled by its input to maintain the selected blend, in a manner to be described.

Figure 2:
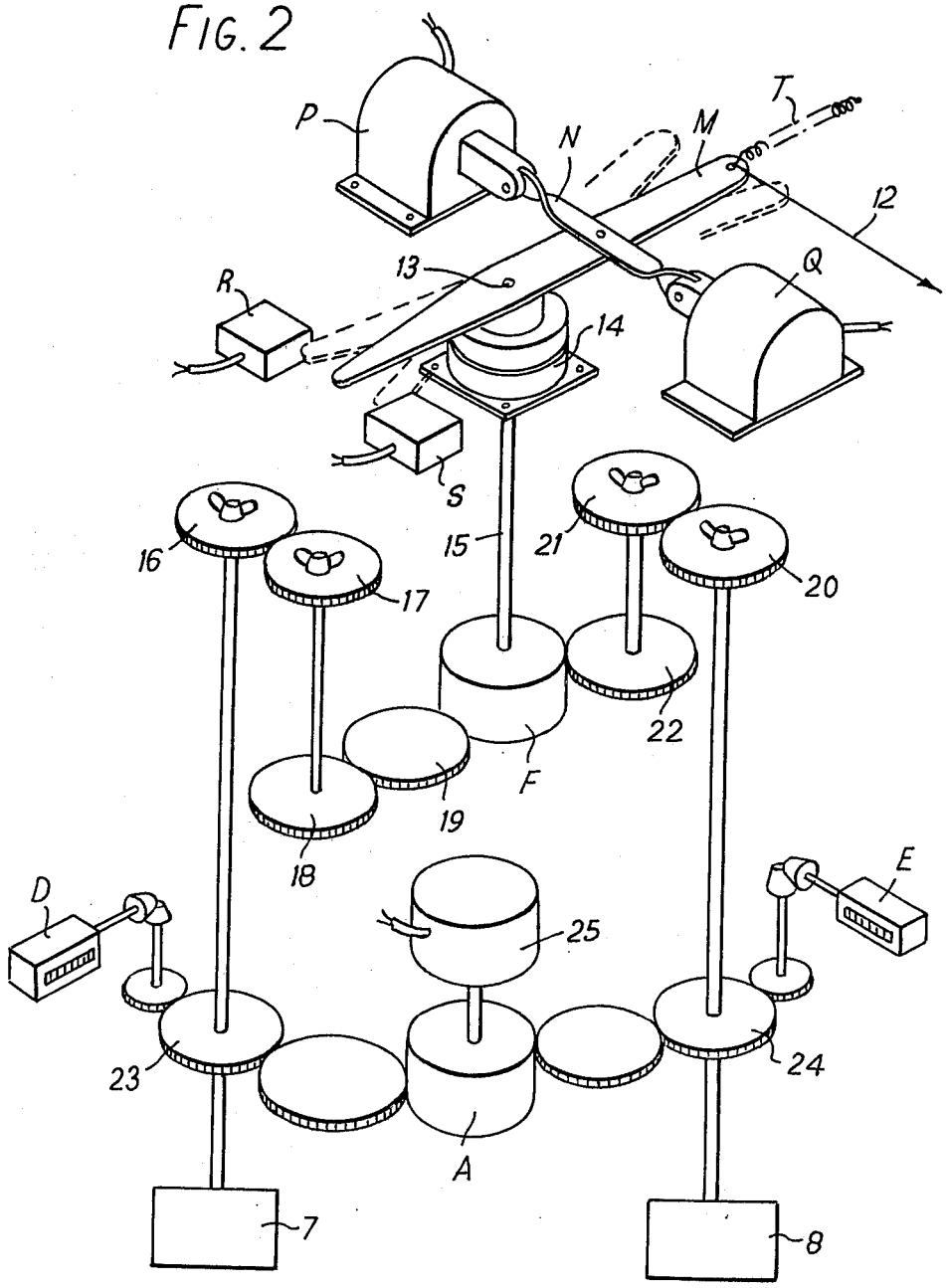
FIG. 2 is a schematic lay-out diagram of the blending control system of the pump of FIG. 1.

Referring now to FIG. 2 the mechanical input to the blend control valve (not shown in FIG. 2) is illustrated by a link 12. The link 12 is coupled to one end of an operating lever M which pivots about an axis 13. A spring T coupled at one end to the end of lever M and at its other end to a fixed part of the casing for the system is effective to bias the lever normally to its mid-position.

A pair of solenoids P and Q are mechanically connected in opposition by a link N which is coupled to the lever M. Energisation of solenoid P will throw the lever to its anti-clockwise limit position (as seen in FIG. 2) and this has the effect, by virtue of link 12, of controlling the blend control valve to dispense only low octane fuel. In this limit position the other end of lever M operates a micro-switch S which is a cut-out switch in the circuit of the motor of the high octane pump 5. Thus, when low octane fuel is selected by depression of button L the solenoid P is energised and the switch S cuts out the motor of high octane pump 5. This ensures that only low octane fuel is dispensed.

When the button H is depressed for selection of high octane fuel the lever M is drawn by solenoid Q to the clockwise limit position (as seen in FIG. 2) and this, by virtue of link 12, ensures that the blend control valve is thrown to the limit position which dispenses only high grade fuel. At the same time, a cut-out switch R is operated by the other end of lever M and this is in series with the motor of the low grade pump 3 and cuts that pump out.

The pump also gives a single pre-selected intermediate blend of fuel when button B is depressed. This has the effect of energising an electromagnetic clutch 14. Energisation of clutch 14 engages a drive to cause the lever M to be rotated by the output shaft 15 of a subtracting differential F. Differential F has two inputs which are driven respectively by a first gear train comprising gears 16, 17, 18 and 19 and a second gear train comprising gears 20, 21 and 22. Gear 16 is driven directly by the low octane meter 7 and gear 20 is driven directly by the high octane meter 8. The arrangement is such that when the pumps are running the meters 7 and 8 will turn continuously in proportion to the flow of the respective fuels. Drives will be applied to the respective inputs of the differential F in accordance with the gear ratios of the two gear trains. If the flow of fuel in the respective conduits is appropriate to the required blend, then there will be no difference in the inputs applied to differential F and the output shaft 15 will not turn. Thus, the lever M will be maintained in substantially its central position and the blend control valve will not alter. However, if for some reason the ratio of liquid changes this will give an appropriate difference to the inputs of differential F and the output shaft 15 will turn in such a sense as to move the operating lever of the blend control valve in the direction required to redress the balance. This will cause the inputs to the differential F to change in order to bring the output shaft 15 back to its zero position. This is an automatic feedback arrangement which ensures that the selected blend is maintained.

It will be appreciated that the blend ratio which is controlled by the above-described arrangement depends on the ratio of the gear trains. This is selected by the fuel station operator and in order to allow the blend to be changed from time to time the gears 16, 17, 20 and 21 are interchangeable by virtue of the wing nuts shown. Thus, different gears can be substituted and the blend ratio thereby changed.

The purpose of the centering spring T is to set the blend valve to its approximate 50% ratio position. This setting would be substantially correct if this was the required ratio set by the ratio change gears. If these gears were changed to give another ratio the movement of the lever M would be minimal to set the blend control valve to the correct position. This would take place immediately the delivery commenced and the initial error in proportion would be very small.

In order to register the total quantity of fuel dispensed there is provided a gear 23 driven by the meter 7 which, through other gears drives a low octane register D. Similarly, a gear 24 driven by meter 8 drives a high octane register E. Also, gears 23 and 24 drive, through intermediate gears, an adding differential A which sums the outputs from the two meters and applies an input drive to a pulse transducer 25 which gives output pulses indicative of the total fuel dispensed.

Figure 3:
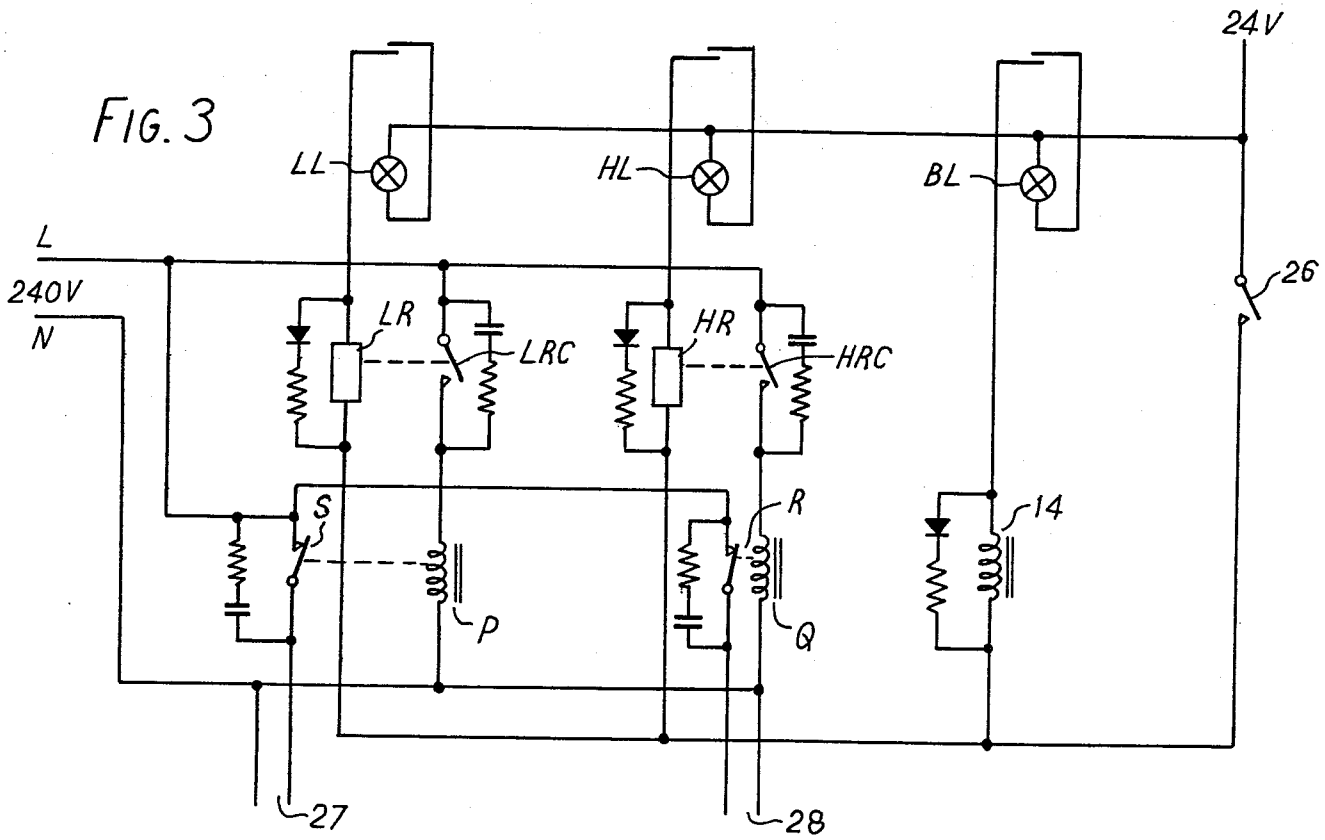
FIG. 3 is a circuit diagram of the blending control system.

Referring now to FIG. 3, there is shown the circuit diagram of the control system. The station is a self-service petrol station and in order to operate the pump the customer first removes from its housing the dispensing nozzle, which is coupled to the outlet 10 (FIG. 1). This has the effect of closing a nozzle switch 26. At a central console (not shown) the station operator has control of all the dispensing pumps. He is able to release the pumps for operation electrically. If the pump has not been released to the customer, the selection procedure may be carried out but the pump motors will not start until the pump has been released. The customer depresses the appropriate push button L, B or H to select the grade required and dispensing can proceed if the operator has released the pump. Under these conditions if button L is depressed an indicator lamp LL is illuminated, the buttons being electrically interlocked so that illumination of lamp LL confirms to the customer that the low blend has been selected and the dispensing operation can proceed. A relay LR is energised. This closes a contact LRC which is in series with the solenoid P (FIG. 2). Solenoid P is thus energised and the operating lever is swung over. As described, this opens the switch S which is in series with the motor for the high octane pump, the contacts of which are shown at 27. Thus, the high octane pump is de-energised and the blend control valve is in its extreme position corresponding to the dispensing of low octane fuel. Dispensing can then proceed. Replacing the nozzle at the end of the dispensing operation opens the nozzle switch and de-energises the solenoid and the mechanism returns to its mean position.

If the button H is depressed a lamp LH is illuminated and a relay HR is energised. This closes a contact HRC which energises the solenoid Q. The operating lever is swung over to open contact R and thus de-energises the low octane pump motor, the contacts of which are shown at 28. Thus, the blend control valve is thrown over to the position corresponding to the dispensing of entirely high octane fuel and the low octane motor is de-energised. Dispensing of high octane fuel can thus proceed.

If the button B is depressed for blend selection then a lamp LB is illuminated and the clutch 14 is energised. If, during delivery there is a loss of one fuel grade (for example, an empty supply tank) then the flow through the two meters would not correspond to the ratio set by the ratio change gears and the output from the subtracting differential F would effectively reset the blend control valve to deliver an increasing amount of the deficient product through the lever M until this lever reaches its extreme position and opens the motor switch. Delivery will then stop.

In normal circumstances, when the required delivery is complete the nozzle is returned to its holster thus opening the nozzle-operated switch and switching off the pump motors. At the same time the clutch L is de-energised and the lever M returns to its mean position.

Figure 4:
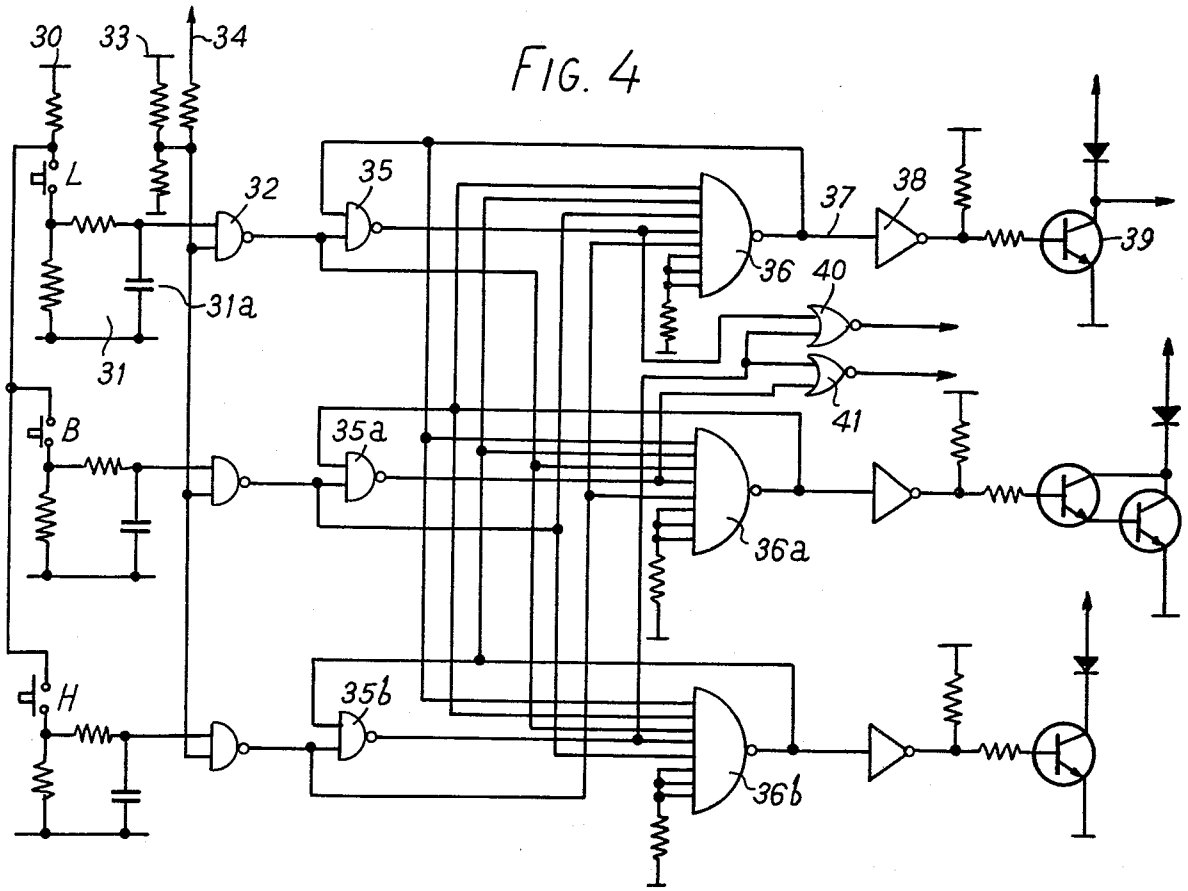
FIG. 4 is a circuit diagram of the interlock circuit for the system of FIG. 3.

Referring to FIG. 4 there is shown the interlock circuit for the push buttons L, B & H whereby the push buttons are interlocked and drive the indicator lamps, relays and clutch of FIG. 3. The operation of the circuit will be understood from a detailed description of the operation for the L button, since the circuits for the H & R buttons are identical. Depression of the L button applies a 12 volt positive input from a supply 30 through an input circuit 31 to one input of a NAND gate 32. The other input of the NAND gate is energised from a 12 volt supply 33 unless an inhibit circuit from a line 34 is closed. Line 34 leads to the central operator console (not shown) and the state of connection of line 34 determines whether the pump is "enabled" to allow the operation of buttons L, B & H to be effective. If positive voltages are available at both inputs of the NAND gate 32 as a result of the pump being enabled and the L button being depressed, the gates give a negative output to one input of a further NAND gate 35. The output of NAND gate 35 is thus rendered positive and this positive voltage is applied to one input of a further NAND gate 36. Provided none of the other inputs of the NAND gate 36 is negative, the gate will provide a negative output at 37. This negative output is applied by a feedback path to the other input of the gate 35 so as to maintain the output of this gate positive. Each button is provided with gates equivalent to gates 35 and 36, those for button B being shown at 35*a* and 36*a* respectively and those for button H being shown at 35*b* and 36*b* respectively. Interlocking is provided by taking a connection from the first input of each of the gates 35, 35*a* and 35*b* and applying the signal thereon to inputs of the other two gates of the series 36, 36*a* and 36*b*. Thus, if a negative input is applied to the first input of one of the gates 35, then the other two gates 36 will be inhibited.

The input circuits 31 each have a capacitor 31*a* which is charged on depression of the appropriate button. This maintains the input to the first input of gate 32 for a time dependent upon the discharge time of the capacitor. This allows the circuit potentials to be established and the interlock function is taken over by the potential on the feedback points 37. It will be seen that there is a connection from each feedback point 37 to two inputs of the other NAND gates of the series 36, 36*a* and 36*b*. Thus, once one of the outputs of a gate of the 36 series becomes negative, the other gates are thereby maintained in an inhibited condition.

The output from point 37 is applied to an inverting amplifier 38 which, if the potential on point 37 is negative, as described by the application of button L, produces a positive input to a transistor 39, thus switching the transistor on. This applies energisation to the lamp LL and the relay LR as described with reference to FIG. 3.

In order to provide an indication of the blend selected at the central console, a pair of NOR gates 40 and 41 has inputs connected to the outputs of the amplifiers 35, 35*a* and 35*b*. The interconnection of the inputs to the NOR gates gives a binary coded output on the two outputs in accordance with the grade selected. This output is decoded at the central control and used to illuminate an appropriate indicator lamp.

We claim:

1. A liquid blending control system for providing an output which is selectively (a) a first liquid; (b) a second liquid; and (c) a predetermined blend of the first and second liquids, the sytem comprising first and second conduits for conveying the first and second liquids respectively; an outlet coupled to the conduits; a blend control valve connected to control the proportions of the first and second liquids admitted to the outlet from the conduits; an operating lever coupled to control the control valve; first and second solenoids coupled to the operating lever and effective, on being energised, to throw the control lever to one extreme position or the other extreme position respectively and thus control the blend control valve to produce at the outlet the first liquid only or the second liquid only respectively; first and second flow meters in the first and second conduits respectively; a differential having first and second inputs and an output shaft which turns in proportion to the difference between the drives applied to the two inputs; first and second gear trains coupling the flow meters to respective inputs of the differential; an electromagnetic clutch for selectively coupling the output shaft to turn the operating lever, the arrangement including the differential being such that when the clutch is engaged the blend control valve is controlled by the drive from the flow meters to maintain the predetermined blend; and a control circuit which allows one solenoid or the other or the clutch to be energised selectively in accordance with the output required.

2. A liquid blending control system as claimed in claim 1 wherein there are electric pumps in the first and second conduits respectively and cut-out switches are provided for the respective pumps, each cut-out switch being operated by the operating lever when in a respective one of the extreme positions.

3. A liquid blending control system as claimed in claim 1 wherein the lever is biased to a mid-position by a spring, movement of the lever away from the mid-position in either direction being effected against the action of the spring.

4. A liquid blending control system as claimed in claim 1 wherein the gears of at least the first or second gear train are readily changeable to alter the gear ratio between the gear trains.

* * * * *